US007146995B2

(12) United States Patent
Lapping

(10) Patent No.: US 7,146,995 B2
(45) Date of Patent: Dec. 12, 2006

(54) TENT FRAME FITTED FOR MULTIPLE CANOPIES

(76) Inventor: Hal Lapping, 567 Stonemount Dr., Weston, FL (US) 33326

( * ) Notice: Subject to any disclaimer, the term of this patent is extended or adjusted under 35 U.S.C. 154(b) by 177 days.

(21) Appl. No.: 10/983,052

(22) Filed: Nov. 4, 2004

(65) Prior Publication Data

US 2006/0090786 A1 May 4, 2006

(51) Int. Cl.
*E04H 15/34* (2006.01)

(52) U.S. Cl. ..... 135/121; 135/95; 135/97; 135/158; 403/170

(58) Field of Classification Search ..... 135/121, 135/135, 158, 159, 144, 115, 95, 97, 119; 403/170–171, 101–102; 52/82–83
See application file for complete search history.

(56) References Cited

U.S. PATENT DOCUMENTS 2,044,659 A * 6/1936 Adams ..... 135/99
2,137,625 A * 11/1938 Norvell ..... 135/147
2,535,618 A * 12/1950 Williams ..... 135/158
5,441,069 A * 8/1995 Moss ..... 135/124
5,711,337 A * 1/1998 McKenney ..... 135/121
5,730,281 A * 3/1998 Powell et al. ..... 206/223
6,000,175 A * 12/1999 Gale et al. ..... 52/63
6,170,503 B1 * 1/2001 Lin Shy ..... 135/119
2002/0170588 A1 * 11/2002 Seo ..... 135/90

OTHER PUBLICATIONS

Economy Party Tent and Canopy, tent construction, Oct. 14, 2004, www.economytent.com.

* cited by examiner

*Primary Examiner*—Winnie Yip

(57) ABSTRACT

The tent frame supports a traditional canopy, a tension canopy and a pagoda canopy and can be configured as a tent assembly kit. The tent frame includes uprights removably fitted into respective corner fittings along with generally horizontal tent frame cross members also fitted into the corner fittings. Canopy support members have one end removably coupled to the corner pieces and a crown fitting receives the other end of the canopy support member. A removable vertical extension piece is removably mounted atop the crown fitting such that when the extension piece is threaded to the crown fitting, the pagoda canopy can be utilized with the assembled tent frame or, in a different tent assembly without the extension piece, the tent frame retains and supports either the traditional canopy or the tension canopy.

6 Claims, 2 Drawing Sheets

FIG.1
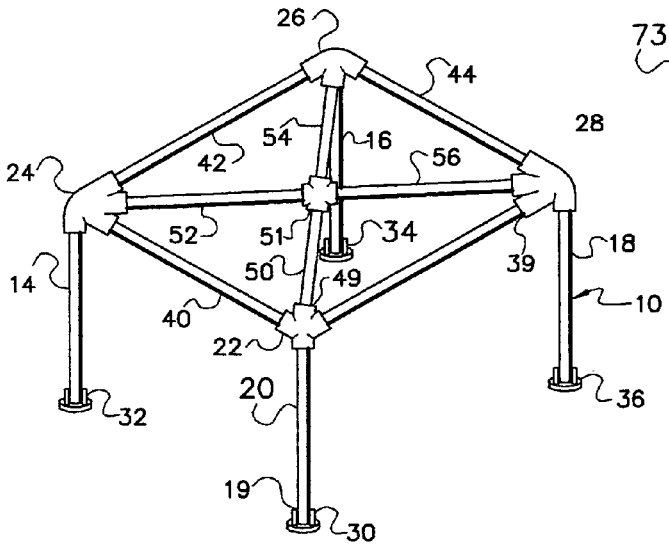
Fig.4
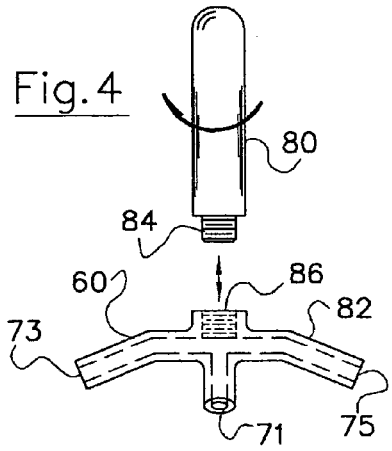
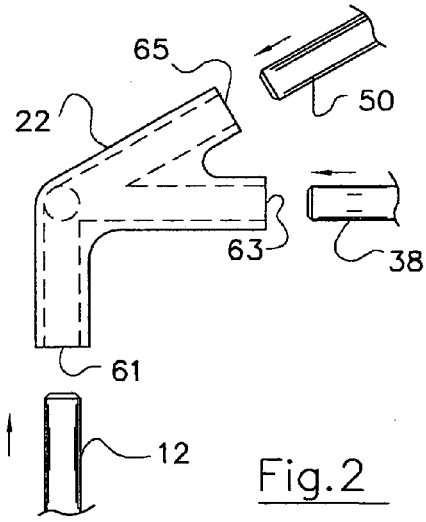
Fig.2
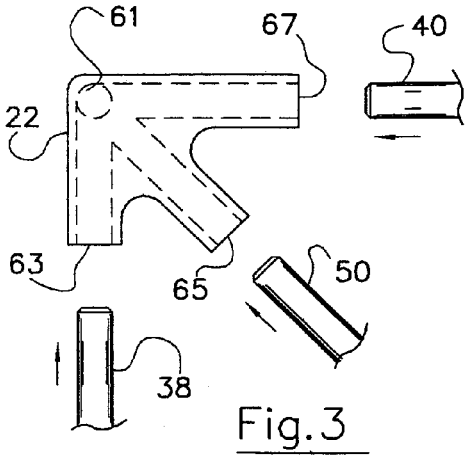
Fig.3

TENT FRAME FITTED FOR MULTIPLE CANOPIES

The present invention relates to a tent frame adapted to support a traditional canopy, a tension canopy and a pagoda canopy and a kit for tent assemblies with multiple tent canopies.

BACKGROUND OF THE INVENTION

For many years, portable tent frames have been utilized to support tent canopies. These tent frames are typically utilized by street vendors, by vendors at art fairs, and event planners for parties and functions to provide shade and/or protection from adverse weather conditions on a temporary basis. Therefore, typical tent frames and the associated tent canopies must be easily transportable, relatively easily assembled, disassembled, and removed from the venue.

A problem arises in that there are several different types of canopies utilized for tent frames. The traditional canopy is attached to the assembled tent frame by straps, buckles or velcro ties thereby tying the canopy to the horizontal tent frame cross members. A tension canopy can also be utilized which includes downlines creating a tension along the lower periphery of the canopy. With respect to tension canopies, the canopy is held up by the horizontal tent frame cross members and the canopy support members leading to a crown piece. In order to give a completely different look to the tent, a pagoda canopy is utilized. However, a problem exists in that the pagoda canopy typically utilizes a different tent frame assembly as compared with the tent frames for a traditional canopy and tension canopy. There is a need to provide a single tent frame adopted to support multiple canopies.

OBJECTS OF THE INVENTION

It is an object of the present invention to provide a tent frame adopted to support multiple canopies such as a traditional canopy, a tension canopy and a pagoda canopy.

It is a further object of the present invention to provide a tent assembly kit which includes the traditional canopy, tension canopy, pagoda canopy and a tent frame that can be configured to support multiple or different canopies.

SUMMARY OF THE INVENTION

The tent frame supports a traditional canopy, a tension canopy and a pagoda canopy and can be configured as a tent assembly kit. The kit includes these three (3) types of canopies. The tent frame assembly includes tent uprights removably fitted into respective corner fittings along with generally horizontal tent frame cross members also fitted into the corner fittings. Canopy support members have one end removably coupled to the corner pieces. Accordingly, the corner pieces couple an upright and the two (2) adjoining horizontal tent frame cross members and one end of a canopy support member. A crown fitting receives the other end, an upper end, of the canopy support member. A removable vertical extension piece is removably mounted atop the crown fitting such that when the extension piece is threaded to the crown fitting, the pagoda canopy can be utilized with the assembled tent frame or, in a different tent assembly without the extension piece, the tent frame retains and supports either the traditional canopy or the tension canopy.

BRIEF DESCRIPTION OF THE DRAWINGS

Further objects and advantages of the present invention can be found in the detailed description of the preferred embodiments when taken in conjunction with the accompanying drawings in which:

FIG. 1 diagrammatically illustrates the tent frame, frame uprights, generally horizontal frame cross members, canopy support members and corner fittings and a crown fitting in accordance with the principles of the present invention;

FIG. 2 diagrammatically illustrates a side elevational view of a corner fitting;

FIG. 3 diagrammatically illustrates a top view of the corner fitting;

FIG. 4 diagrammatically illustrates a crown fitting for four canopy support members;

DETAILED DESCRIPTION OF THE PREFERRED EMBODIMENTS

Figure 5A:
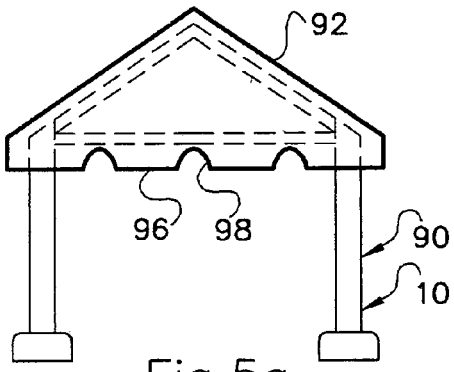
FIG. 5A diagrammatically illustrates the tent frame supporting a traditional canopy.

The present invention relates to a tent frame and a tent assembly kit which supports a traditional tent canopy, a tension tent canopy and a pagoda tent canopy.

FIG. 1 diagrammatically illustrates tent frame 10 having tent frame uprights 12, 14, 16, 18. The upper ends, for example end 20 of upright 12, are removably attached to corner pieces 22, 24, 26 and 28. The bottom end of each upright, for example end 19 of generally vertical upright 12, is removably mounted in bases 30, 32, 34 and 36. Generally horizontal tent frame cross members 38, 40, 42 and 44 have opposing ends, for example, end 37 and end 39 of cross member 38. The horizontal members are raised above the ground plane and the bases by the uprights. One end of the cross member is removably mounted in one of the corner pieces, such as end 37 removably mounted into corner piece 22, and the other end, such as end 39, is removably mounted in a different corner member or piece such as corner member 28 removably coupled to end 39 of cross member 38. Four canopy support members 50, 52, 54 and 56 are angularly disposed and rise above the corner fittings and each canopy support members has one end removably mounted to a corner piece and the other end removably mounted to a crown fitting 60. Therefore, end 49 of canopy support member 50 is removably coupled to corner piece 22 and end 51 of canopy support member 50 is removably mounted into crown fitting 60. Crown fitting 60 has at least four receiving channels. The crown fitting 60 can have a number of receiving channels such as six receiving channels to receive a plurality of additional support members. It should be noted that tent assemblies having more than four uprights are covered within the scope of the present invention. Tent assemblies with four, five and six uprights may be utilized and the crown fitting includes four, five and six receiving channels for the respective number of canopy support members.

FIG. 2 diagrammatically shows corner fitting 22 having three visible receiving channels 61, 63 and 65 each adapted to receive frame members 12, 38 and 50 representing frame uprights, horizontal cross members and canopy support members.

FIG. 3 is a top view of corner piece fitting 22 showing the two removably mounted cross members 38 and 40 adapted to be removably inserted into receiving channels 63, 67.

FIG. 4 shows crown fitting 60 having receiving channels 71, 73 and 75. The fourth receiving channel is not visible in FIG. 4. Receiving channel 71 receives canopy support member 50, channel 73 receives canopy support member 52 and channel 75 receives canopy support member 56. A removable vertical extension piece 80 is removably mounted atop crown fitting 60 along top surface 82. Preferably, vertical extension piece 80 includes a threaded member 84 which cooperates with a complementary threaded member 86 in top 82 of crown fitting 60. Extension 80 is used to configure the pagoda tent canopy.

Figure 6A:
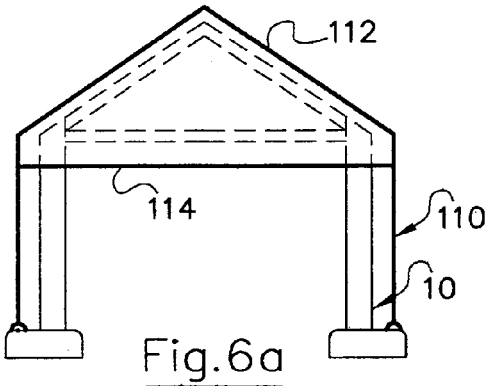
FIG. 6A diagrammatically illustrates the tent frame supporting a tension canopy.
Figure 7:
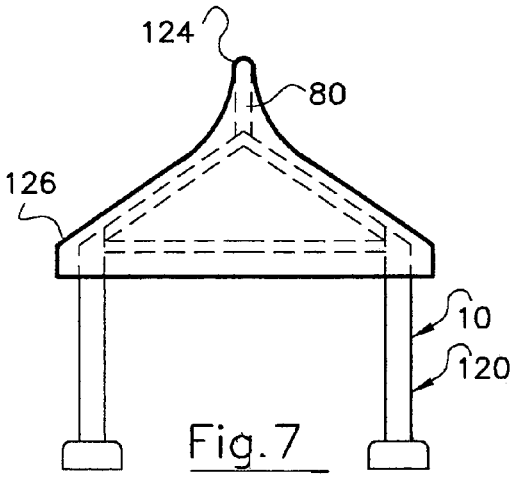
FIG. 7 diagrammatically illustrates the tent frame with a pagoda canopy.

FIG. 5A shows a first tent assembly 90 (traditional). FIG. 6A shows a second tent assembly 110 (tension) and FIG. 7 shows a third tent assembly 120 (pagoda).

Figure 8:
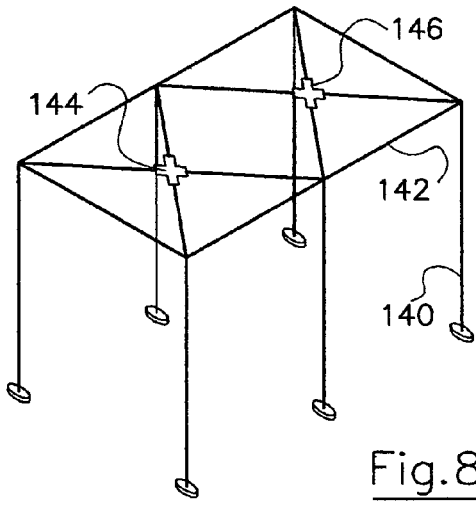
FIG. 8 schematically illustrates a tent frame with multiple frame uprights, greater than 4.

First tent assembly in FIG. 8 shows a tent frame assembly 10 supporting a traditional tent canopy 92.

Figure 5B:
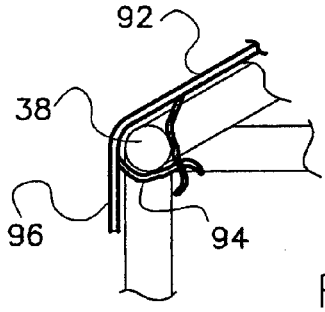
FIG. 5B diagrammatically shows attachment of the traditional canopy to the assembled tent frame.

FIG. 5B shows that traditional canopy 92 is tied or fixed to horizontal cross member 38 via a strap, tie, belt, buckle or velcro attachment 94. Down flap 96 of traditional canopy 92 includes a plurality of stress relief cutouts, one of which is cutout 98 in FIG. 5.

FIG. 6A shows a tension canopy 112 mounted and supported by tent assembly 10.

Figure 6B:
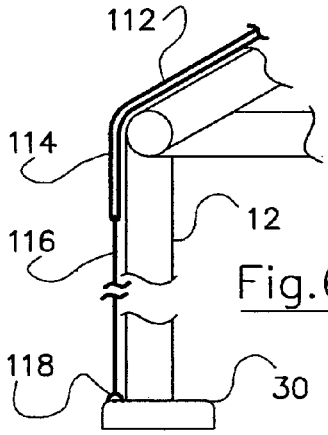
FIG. 6B diagrammatically illustrates one downline creating the tension in the tension canopy.

FIG. 6B shows tension canopy 112 having a down flap or downside 114 connected to a tension downline 116. In one embodiment, tension downline 116 is attached via fitting 118 to base 30. As explained in conjunction with FIG. 1, base 30 is associated with upright 12.

As shown in FIG. 6A, down flap 114 of tension canopy 112 is generally tight and is at a uniform horizontal distance above the ground plane upon which bases 30, 32, 34 and 36 are placed.

FIG. 7 shows a third tent assembly (a pagoda tent assembly) which tent frame assembly 10 including vertical extension piece 80 added to the crown 60 (not shown in FIG. 7). Pagoda canopy 122 provides a gentle curve from top portion 124 to the vertical drop point 126.

In this manner, a singular tent frame assembly 10 can be utilized in conjunction with a traditional canopy (FIG. 5A) a tension canopy (FIG. 6A) or a pagoda canopy (FIG. 7) wherein to achieve a pagoda "look," vertical extension 80 is preferably or removably coupled to crown 60 at the top of the tent assembly 10.

FIG. 8 shows that a plurality of uprights, one of which is upright 140, which supports another plurality of generally horizontal tent frame cross members, on of which is cross member 142. Crown fittings 144, 146 can operate to uphold a traditional canopy or a tension canopy and, with the addition of a removable vertical extension piece 80, support two or more pagoda canopies.

The claims appended hereto are meant to cover modifications and changes within the scope and spirit of the present invention.

What is claimed is:

1. A tent frame assembly kit adapted to support a traditional canopy, a tension canopy and a pagoda canopy, said traditional tent canopy adapted to be attached to the assembled tent frame by straps, buckles or velcro ties thereby tying the traditional canopy to horizontal tent frame cross members, said tension canopy adapted to be attached to the assembled tent frame by downlines creating a tension along a lower periphery of the tension canopy, and said pagoda canopy adapted to form a gentle curve from a topmost canopy portion to a vertical drop-off edge of said pagoda canopy, the tent frame assembly kit comprising:

at least four tent frame uprights with top ends having mounted thereon a respective corner fitting of a plurality of corner fittings corresponding to said tent uprights, said uprights being removably mounted to said corner fittings;

fittings on at least said four uprights for tension downlines provided with said tension canopy;

a plurality of generally horizontal tent frame cross members each with opposing ends, each cross frame member having its ends coupled to a respective corner fitting and a corresponding tent upright, said cross members being removably mounted to said corner fittings, said horizontal frame cross members cooperating with said traditional tent canopy straps, buckles or velcro ties for attachment to said horizontal frame cross members;

a crown fitting with at least four receiving channels;

at least four canopy support members each having opposing ends, one opposing end of each canopy support member coupled to a respective corner fitting and the other opposing end of each canopy support member coupled to said crown fitting, said canopy support members being removably mounted to said corner fittings and said crown fitting;

a removable vertical extension piece removably mounted atop said crown fitting;

whereby an assembled tent frame has a traditional tent assembly mode, a tension tent assembly mode and a pagoda tent assembly mode, each tent assembly mode with said at least four tent frame uprights, said plurality of generally horizontal tent frame cross members, said at least four canopy support members, said plurality of corner fittings and said crown fitting;

in said traditional tent assembly mode, said uprights, cross members and crown fitting support said traditional canopy and said traditional tent canopy straps, buckles or velcro ties are adapted to attach to said horizontal frame cross members;

in said tension tent assembly mode said tension canopy is supported on said uprights, cross members and crown fitting and said downlines are adapted to create tension along said lower periphery of the tension canopy by attachment to said fittings;

in said pagoda tent assembly mode, said vertical extension piece mounted atop said crown fitting supports said pagoda canopy in addition to said uprights and said cross members, and said pagoda canopy forms said gentle curve due to said vertical extension from said topmost canopy portion to said vertical drop-off edge of said pagoda canopy.

2. A tent frame as claimed in claim 1 wherein the extension piece is threaded in said crown fitting.

3. A tent frame as claimed in claim 2 including a plurality of bases corresponding to said tent uprights, a respective base removably mounted to a lower end of each said upright.

4. A kit for tent assemblies with multiple tent canopies comprising:

a traditional tent canopy with straps, buckles or velcro ties for tying the traditional canopy to a plurality of horizontal tent frame cross members;

a tension tent canopy having downlines for creating a tension along a lower periphery of the tension canopy;

a pagoda tent canopy configured to form a gentle curve from a topmost canopy portion to a vertical drop-off edge of said pagoda canopy;

at least four tent frame uprights with top ends having mounted thereon a respective corner fitting of a plurality of corner fittings corresponding to said tent uprights, said uprights being removably mounted to said corner fittings, each said upright having a downline fitting;

a plurality of generally horizontal tent frame cross members each with opposing ends, each cross frame member having its ends coupled to a respective corner fitting and a corresponding tent upright, said cross members being removably mounted to said corner fittings;

a crown fitting with at least four receiving channels;

at least four canopy support members each having opposing ends, one opposing end of each canopy support member coupled to a respective corner fitting and the other opposing end of each canopy support member coupled to said crown fitting, said canopy support members being removably mounted to said corner fittings and said crown fitting;

a removable vertical extension piece removably mounted atop said crown fitting;

wherein a first tent assembly is assembled with said at least four tent frame uprights, said plurality of generally horizontal tent frame cross members, said at least four canopy support members, said plurality of corner fittings and said crown fitting, said traditional canopy upheld with said cross members and canopy support members and said traditional canopy tied with said straps, buckles or velcro ties to said plurality of horizontal tent frame cross members;

wherein a second tent assembly is assembled with said at least four tent frame uprights, said plurality of generally horizontal tent frame cross members, said at least four canopy support members, said plurality of corner fittings and said crown fitting, said tension canopy is supported via said cross members and canopy support members and said downlines attached to said downline fittings for creating tension along said lower periphery of the tension canopy; and wherein a third tent assembly is assembled with said at least four tent frame uprights, said plurality of generally horizontal tent frame cross members, said at least four canopy support members, said plurality of corner fittings and said crown fitting plus said vertical extension piece mounted atop said crown fitting such that said pagoda canopy is supported via said extension piece, said cross members and canopy support members and forming said gentle curve from said topmost canopy portion to said vertical drop-off edge of said pagoda canopy.

5. A kit as claimed in claim 3 wherein the extension piece is threaded in said crown fitting.

6. A kit as claimed in claim 5 including a plurality of bases corresponding to said tent uprights, a respective base removably mounted to a lower end of each said upright.

* * * * *